US010126052B2

(12) United States Patent
Wedel et al.

(10) Patent No.: US 10,126,052 B2
(45) Date of Patent: Nov. 13, 2018

(54) BI-DIRECTIONAL PICK-UP SHOE

(71) Applicant: Kadant Johnson Inc., Three Rivers, MI (US)

(72) Inventors: Gregory L. Wedel, Kalamazoo, MI (US); Gerald L. Timm, Schoolcraft, MI (US); Timothy N. Henry, Marcellus, MI (US)

(73) Assignee: Kadant Johnson LLC, Three Rivers, MI (US)

( * ) Notice: Subject to any disclaimer, the term of this patent is extended or adjusted under 35 U.S.C. 154(b) by 0 days.

(21) Appl. No.: 15/517,223

(22) PCT Filed: Oct. 5, 2015

(86) PCT No.: PCT/US2015/053927

§ 371 (c)(1),
(2) Date: Apr. 6, 2017

(87) PCT Pub. No.: WO2016/057363

PCT Pub. Date: Apr. 14, 2016

(65) Prior Publication Data

US 2017/0248366 A1 Aug. 31, 2017

Related U.S. Application Data

(60) Provisional application No. 62/060,640, filed on Oct. 7, 2014.

(51) Int. Cl.
*F26B 13/18* (2006.01)

(52) U.S. Cl.
CPC ..... *F26B 13/183* (2013.01)

(58) Field of Classification Search
CPC ..... F26B 13/183; F26B 13/18; F26B 17/00; F26B 13/04; D21F 3/08; D21F 9/04
(Continued)

(56) References Cited

U.S. PATENT DOCUMENTS 2,993,282 A 7/1961 Daane et al.
3,601,902 A * 8/1971 Schiel ..... D21F 5/02 165/89

(Continued)

FOREIGN PATENT DOCUMENTS

DE 91 15 926 U1 2/1992
DE 4110709 A1 * 10/1992 ..... D21F 5/028

(Continued)

OTHER PUBLICATIONS

International Search Report dated Dec. 28, 2015.

*Primary Examiner* — Stephen M Gravini
(74) *Attorney, Agent, or Firm* — Young Basile Hanlon & MacFarlane, P.C.

(57) ABSTRACT

An apparatus for removing fluid, such as condensate, from the inside of a rotating cylinder 10. The apparatus comprises a syphon shoe 50 proximate to an inside surface 35 of the rotating cylinder 10. The syphon shoe 50 is connected to a syphon pipe 28. The syphon shoe 50 further comprises two opposing circumferential openings 51, 52 and a divider 60. The two opposing circumferential openings 51, 52 are disposed substantially parallel to the direction of rotation of the rotating cylinder 10. The divider separates the opposing circumferential openings 51, 52 and extends radially from the end of the syphon shoe 50.

20 Claims, 6 Drawing Sheets

(58) Field of Classification Search
USPC ..... 34/110–124; 68/359.1; 162/359.1
See application file for complete search history.

(56) References Cited

U.S. PATENT DOCUMENTS

| | | | | | |
|---|---|---|---|---|---|
| 3,967,386 | A * | 7/1976 | Asfura | D21F 5/10 | 165/89 |
| 4,369,586 | A * | 1/1983 | Wedel | D21F 5/10 | 34/119 |
| 4,384,412 | A | 5/1983 | Chance et al. | | |
| 4,501,075 | A * | 2/1985 | Jenkner | D21F 5/10 | 34/119 |
| 4,516,334 | A * | 5/1985 | Wanke | D21F 5/10 | 34/119 |
| 4,606,136 | A | 8/1986 | Pflug | | |
| 4,663,864 | A | 5/1987 | Schiel | | |
| 4,718,177 | A * | 1/1988 | Haeszner | D21F 5/10 | 34/119 |
| 4,924,603 | A | 5/1990 | Wolf | | |
| 5,020,243 | A * | 6/1991 | Miller | F26B 13/183 | 34/119 |
| 5,024,266 | A | 6/1991 | Critchlow | | |
| 5,109,612 | A * | 5/1992 | Timm | D21F 5/10 | 34/119 |
| 5,335,427 | A | 8/1994 | Partio | | |
| 5,524,355 | A * | 6/1996 | Schiel | D21F 1/48 | 165/90 |
| 5,528,838 | A * | 6/1996 | Timm | D06F 58/04 | 165/89 |
| 5,864,963 | A * | 2/1999 | Komulainen | F26B 13/183 | 34/124 |
| 5,907,909 | A * | 6/1999 | Autio | F28F 5/02 | 165/90 |
| 5,933,979 | A * | 8/1999 | Wedel | D21F 5/042 | 34/117 |
| 6,049,999 | A * | 4/2000 | Skaugen | D21F 5/042 | 34/117 |
| 7,018,513 | B2 | 3/2006 | Smith | | |
| 8,082,680 | B2 * | 12/2011 | Ives | F26B 13/183 | 162/358.1 |
| 8,826,560 | B2 * | 9/2014 | Beach | F28F 5/02 | 162/359.1 |
| 2011/0099856 | A1 | 5/2011 | Ives et al. | | |
| 2017/0248366 | A1 * | 8/2017 | Wedel | F26B 13/183 | |

FOREIGN PATENT DOCUMENTS

| | | | | |
|---|---|---|---|---|
| EP | 2113730 | A2 * | 11/2009 | F26B 13/183 |
| JP | 02014092 | A * | 1/1990 | D21F 5/10 |

* cited by examiner

BI-DIRECTIONAL PICK-UP SHOE

CROSS-REFERENCE TO RELATED APPLICATION

This application claims the benefit of U.S. Provisional Application Ser. No. 62/060,640 filed on Oct. 7, 2014, which is incorporated herein in its entirety by reference.

TECHNICAL FIELD

This disclosure relates to devices for removing condensed steam from the interior of a rotating steam-heated cylinder, and more specifically, to improvements in the pickup shoe affixed to a stationary syphon pipe disposed within such a cylinder.

BACKGROUND

In the web and film converting process, for example papermaking, the flat webs or films are heated by transporting them over and around one or more hollow metal cylinders. Such hollow cylinders are heated by steam and serve to perform the heating process during manufacturing. These cylinders are typically between four and seven feet in diameter. Steam is supplied to each cylinder through a rotary joint, thence through a roll journal, and thence into the interior of the cylinder. Inside the cylinder, the steam condenses as it transfers heat to the interior wall of the cylinder. The condensed steam or "condensate" must then be removed so that the cylinder does not fill with water. This condensate is removed through a syphon pipe, which, in turn, is connected to an external pipe or tank. Syphon pipes may rotate with the cylinder ("rotary" syphons) or remain fixed in relation to the rotary joint ("stationary" syphons). Stationary syphons that are used to remove condensate are attached to a stationary portion of the rotary joint to prevent the syphon from rotating with the cylinder.

In prior stationary syphon designs, the syphon pipe extends to and is positioned close to the inside surface of each heating cylinder. To improve the collection of condensate, a syphon shoe is connected to the end of the syphon pipe, and positioned adjacent to the inside surface of the cylinder. The syphon shoe is configured to collect the condensate, which is moving along the inner circumference of the cylinder. Generally, the syphon shoe is positioned close to the interior surface in order to prevent large amounts of condensate from accumulating inside the cylinder. The rotational velocity of the cylinder, and hence, the condensate, serves to force condensate into the syphon shoe.

At high operating speeds, a portion of the condensate that is collected inside the rotating cylinders will rotate with the cylinders in a condition termed "rimming". For efficient operation at high operating speeds, the end of the stationary syphon that is facing the inside surface of the rotating cylinder is formed with an opening facing in the circumferential direction with an angled or contoured inner surface to scoop the rimming condensate from the inside surface of the rotating cylinder and re-direct it into the radial syphon pipe fluid passage and ultimately, out of the rotating cylinder. Typically, the pickup shoe affixed to the end of the syphon is provided with a single opening oriented circumferentially, which serves to perform the desired pickup of condensate, assuming that the cylinder, in operation, rotates in only a single direction. This configuration is taught by Partio in U.S. Pat. No. 5,335,427, Jenkner, et al., U.S. Pat. No. 4,501,075, and our U.S. Pat. No. 8,082,680. In some special applications, however, the cylinder may rotate in either a clockwise or counter-clockwise direction, depending on manufacturing requirements. In such applications, a stationary syphon shoe with its opening facing in the single circumferential direction will not adequately drain the condensate in the rotating cylinder when the cylinder is operating in the opposite direction.

For such applications, conventional stationary syphons are formed with an opening facing radially toward the inside surface of the rotating cylinder. This configuration allows the condensate to be removed from the rotating cylinder regardless of the direction of the rotation of the cylinder. Typical of this configuration is the device taught by Chance, et al., U.S. Pat. No. 4,384,412. However, in order for this configuration to function, the centrifugal force that tends to hold the condensate against the inside surface of the rotating cylinder must be overcome. This requires a high pressure difference between the pressure near the inside surface of the rotating cylinder and the pressure of the external pipe or tank where the condensate is exhausted from the syphon pipe. The high differential pressure is what entrains and lifts the condensate off the inside surface of the rotating cylinder and into the radial syphon pipe.

It is desirable, therefore, to provide a pickup shoe which performs the function of removing condensate from the interior of a rotating cylinder, regardless of the direction of rotation in said cylinder, without the need for high differential pressures and without allowing excessive amounts of steam to leave the rotating cylinder without condensing.

SUMMARY

An apparatus for removing fluid, such a condensate, from the inside of a rotating cylinder includes a syphon shoe proximate to the inside surface of the rotating cylinder. The syphon shoe is connected to a syphon pipe. The syphon shoe further comprises two opposing circumferential openings and a divider. The two opposing circumferential openings are disposed substantially parallel to the direction of rotation of the rotating cylinder. The divider separates the opposing circumferential openings and extends radially from the end of the syphon end.

In an alternative embodiment, an apparatus for removing fluid, such as a condensate, from the inside of a rotating cylinder includes a syphon shoe proximate to the inside surface of the rotating cylinder. The syphon shoe is connected to a syphon pipe. The syphon shoe further comprises two opposing circumferential openings and a divider. The two opposing circumferential openings are disposed substantially parallel to the direction of rotation of the rotating cylinder. The divider separates the opposing circumferential openings, extends radially from the end of the syphon end, and has two curved surfaces that each face one of the opposing circumferential openings. Each of the opposing circumferential openings has a central portion and opposing end portions.

BRIEF DESCRIPTION OF THE DRAWINGS

The features of the present invention will be best understood from the within detailed description and an embodiment thereof selected for purposes of illustration and shown in the accompanying drawings in which.

DETAILED DESCRIPTION OF THE INVENTION

Figure 1:
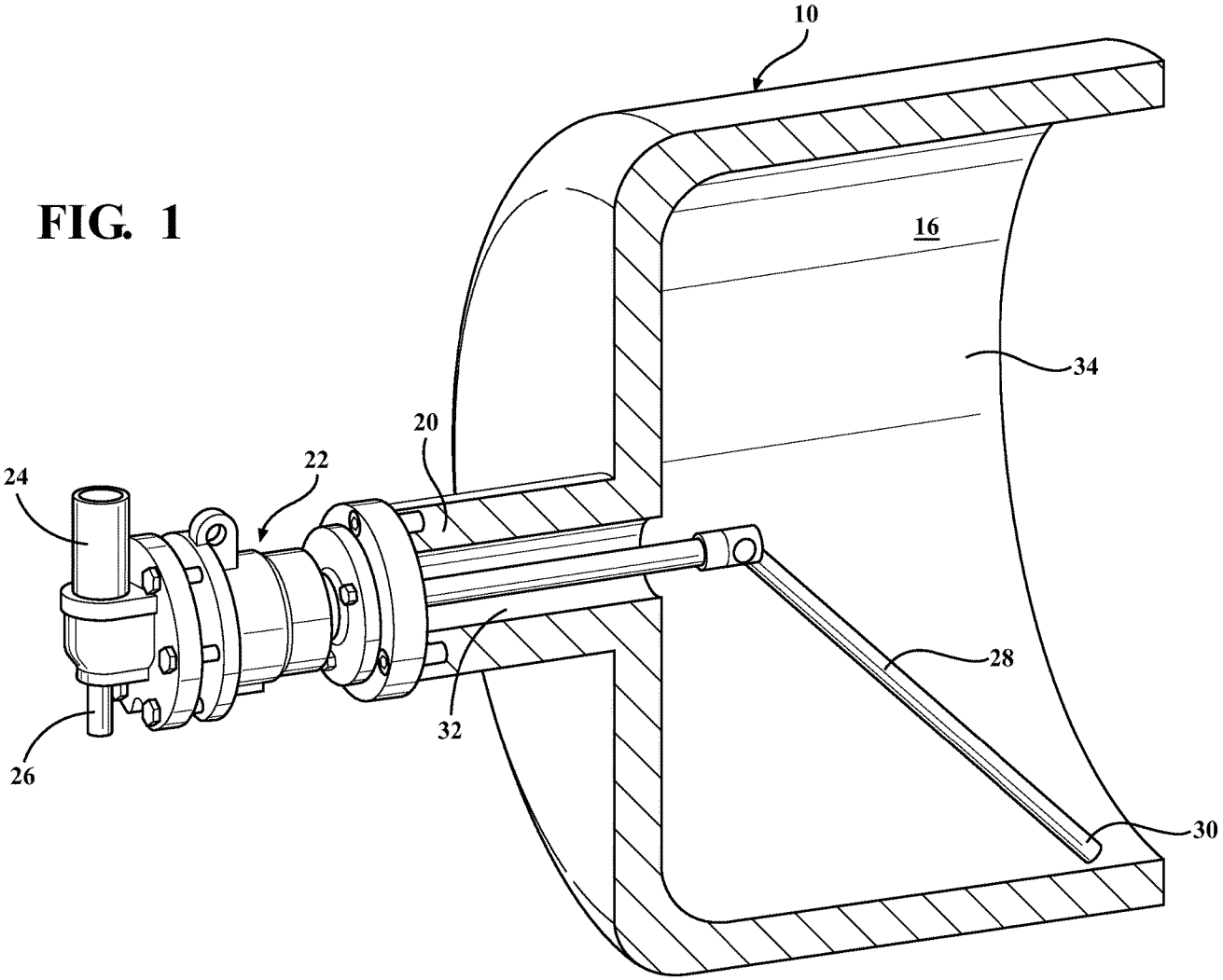
FIG. 1 is a perspective cutaway view of the prior art.

With reference first to FIG. 1, the general structure of a rotating cylinder 10 is depicted. Also illustrated are the general orientation and structure of the system for supplying steam and draining condensate to and from the rotating cylinder 10 in a typical web or film heating process. In the prior art, a plurality of rotating cylinders 10 are arranged in an array (not shown); a web or film of material, such as paper, paper board, or plastic is passed over and around adjacent rotating cylinders 10. This plurality of rotating cylinders 10 forms a heating section that serves to progressively raise the temperature of the web or film. The rotation of the rotating cylinders 10 serves to drive, support, and heat the web. By heating the rotating cylinders 10, the web or film is progressively heated to the desired operating temperature by contact with the exterior walls of the rotating cylinders 10.

To heat the rotating cylinders 10, pressurized steam is introduced into an interior chamber 16 of the rotating cylinders 10 through a steam supply inlet 24. A rotary joint 22 is interposed between the steam supply network (not shown) and each rotating cylinder 10. The rotary joint 22 serves to permit the rotating cylinder 10 to rotate and provides a seal between the rotating cylinder 10 and the steam supply inlet 24 and a condensate outlet 26. Such rotary joints 22 are well known in the art. Typically, steam enters the rotating cylinder 10 through a passage 32 in a cylinder journal 20, the heat from said steam serving to elevate the temperature of exterior walls 12 of the rotating cylinders 10 to a predetermined desired level. As the rotating cylinder 10 is heated, the steam condenses into water, which may collect at the bottom of the rotating cylinder 10 or adhere to an interior wall 34 of the rotating cylinder 10 by virtue of the centrifugal force imparted by the rotation of the rotating cylinder 10.

A stationary syphon pipe 28 is secured to a stationary portion of the rotary joint 22 and communicates with the condensate outlet 26. The distal end 30 of the syphon pipe 28 is positioned in close proximity to the interior wall 34 of the rotating cylinder 10. The steam supplied to the interior chamber 16 of the rotating cylinder 10 from the steam supply network is supplied at high pressure, maintaining a pressurized atmosphere within the rotating cylinder 10. As a result, the condensate that collects in the interior walls 34 of the rotating cylinder 10 is urged into the syphon pipe 28 where it is exhausted to the condensate outlet 26.

A similar configuration may be found in heating systems that utilize a rotary syphon. In such systems, the syphon pipe 28 is secured to a rotating portion of rotary joint 22. The syphon pipe 28 then rotates as the rotating cylinder 10 and the cylinder journal 20 rotate, with the distal end 30 of the syphon pipe 28 being positioned adjacent to the same point in the interior wall 34 of the rotating cylinder 10, regardless of the rotational position of the rotating cylinder 10.

Figure 2:
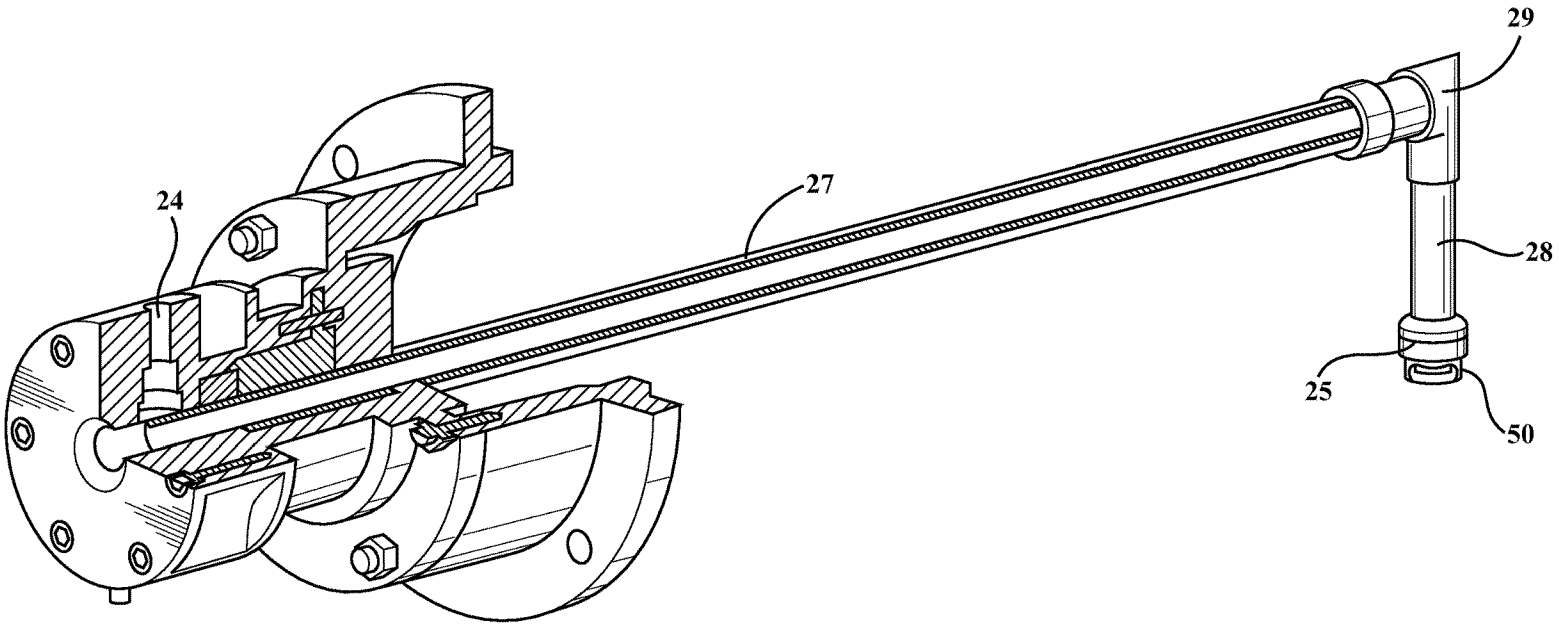
FIG. 2 is a perspective, partially cutaway view of the environment that the syphon assembly is intended to operate.
Figure 3:
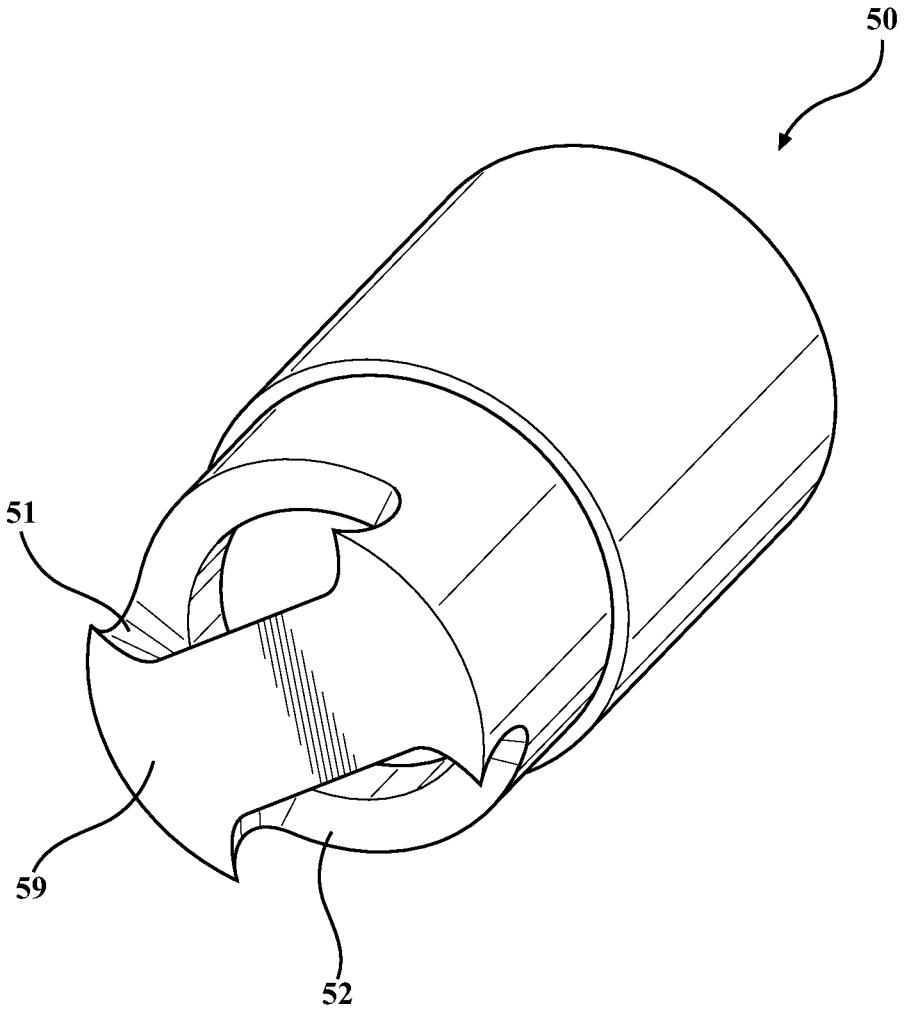
FIG. 3 is a perspective view of the syphon assembly.
Figure 4:
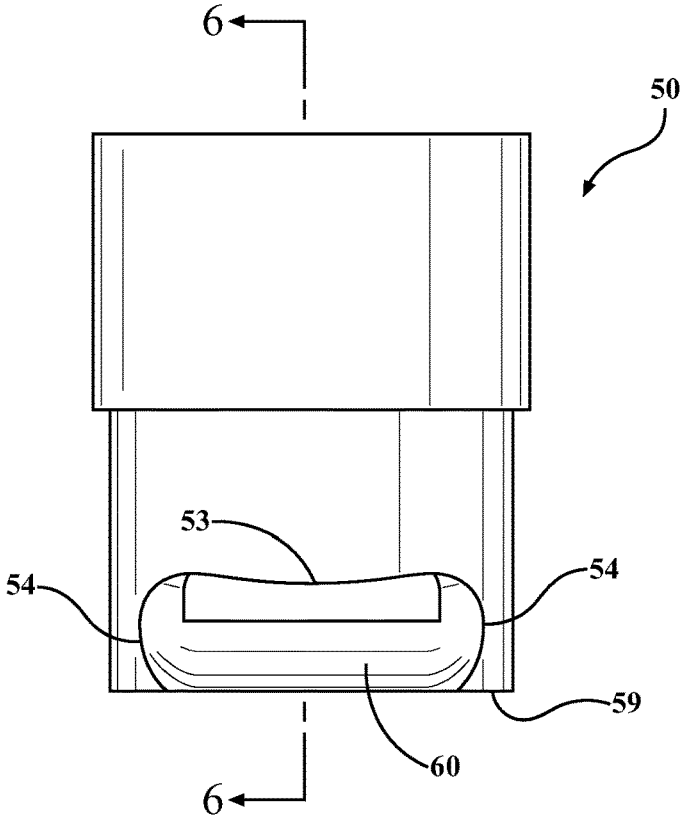
FIG. 4 is a side view of the syphon assembly.
Figure 5:
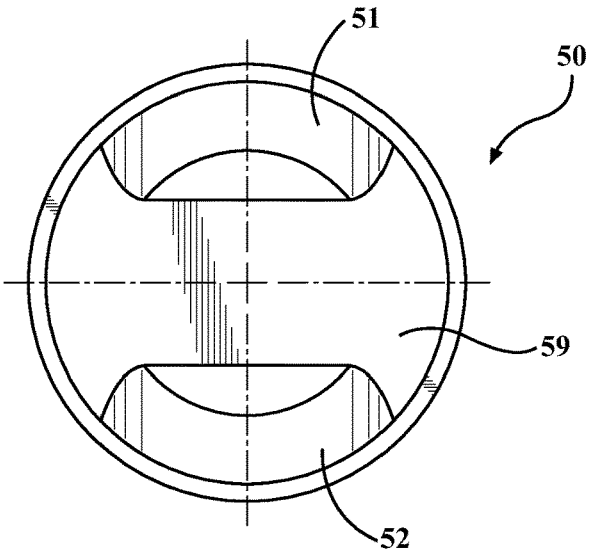
FIG. 5 is a bottom view of the syphon assembly.
Figure 6:
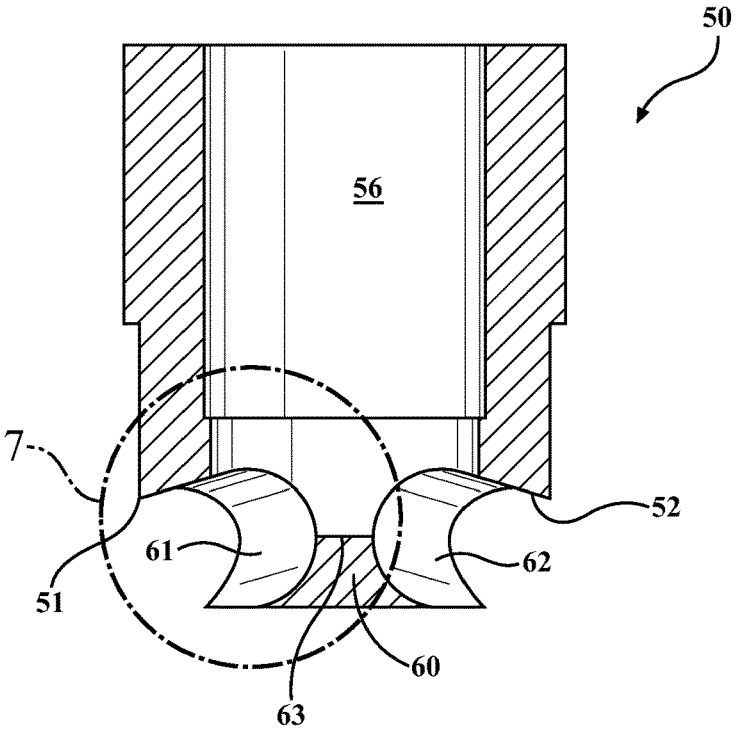
FIG. 6 is a cross-sectional, longitudinal view of the syphon assembly taken along line 6 of FIG. 4.
Figure 7:
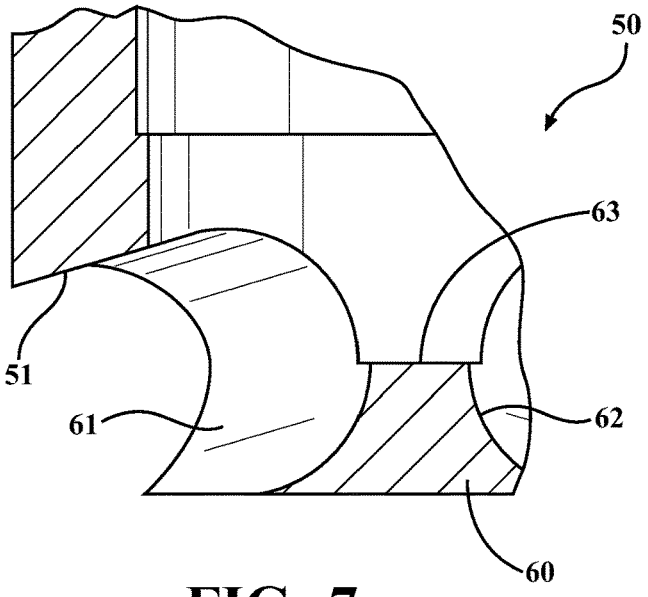
FIG. 7 is a detail view taken along line 7 of FIG. 6.
Figure 8:
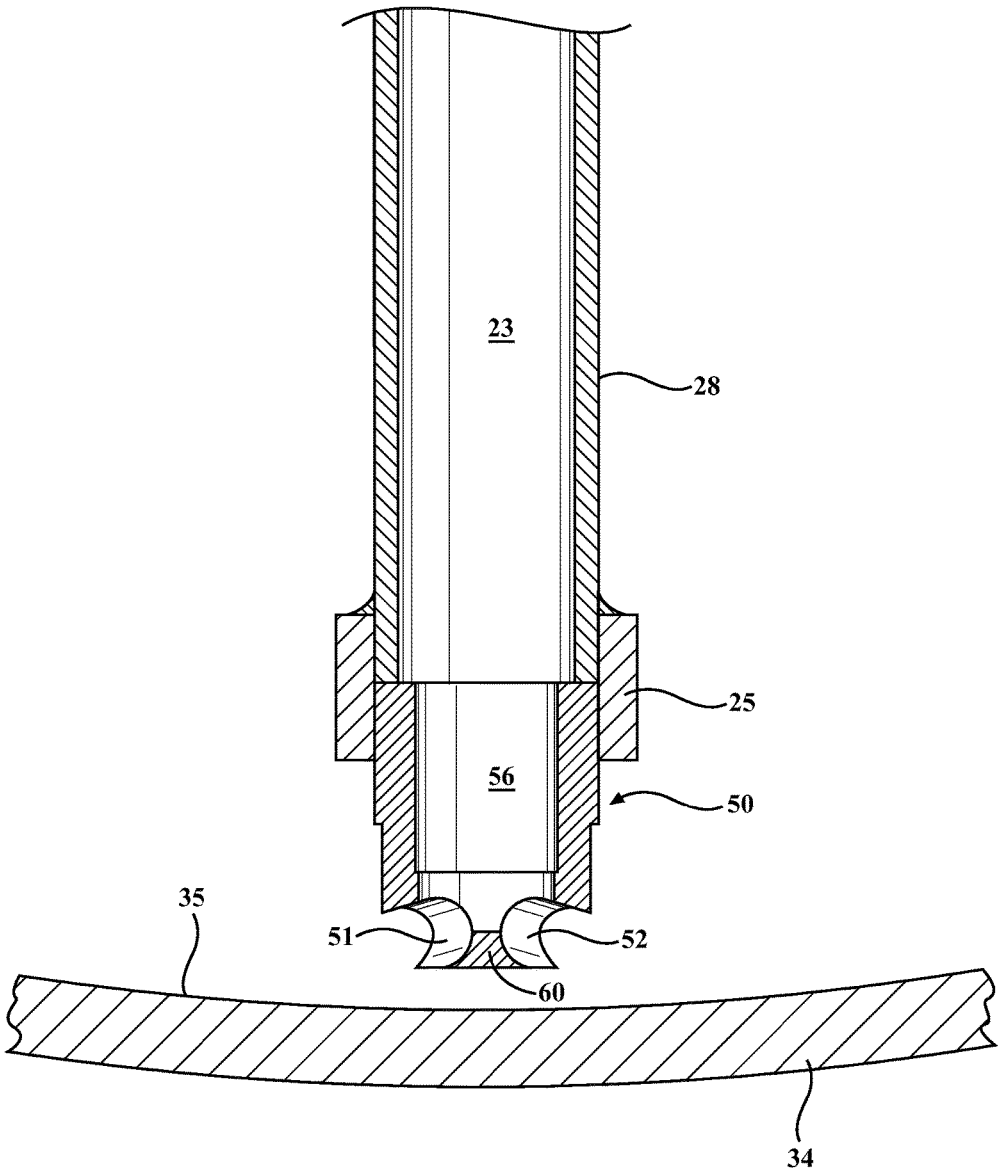
FIG. 8 is a cross-sectional view of the syphon assembly and a rotating cylinder.

With reference now to FIG. 2, the improvement of the syphon assembly will be best understood. In the disclosed syphon assembly, as in the prior art, a steam supply inlet 24 introduces steam, under pressure, into the interior chamber 16 of a rotating cylinder 10. As the heat is exchanged between the steam and the rotating cylinder 10, condensate forms which collects at the bottom of the cylinder 10 or which adheres to the interior walls 34 in the "rimming" condition. A horizontal syphon pipe 27 is secured in relation to the rotary joint 22 and the rotating cylinder 10 in such a fashion that the syphon pipe 27 remains stationary as the rotating cylinder 10 rotates. A radial syphon pipe 28 is affixed to the horizontal syphon pipe 27 and communicates therewith through a locking elbow fitting 29. The radial syphon pipe 28 is dimensioned to position a contoured syphon shoe 50 in close proximity to the interior wall 34 near the bottom of the rotating cylinder 10.

The contoured syphon shoe 50 will be best appreciated with reference to FIGS. 3-8. The contoured syphon shoe 50 incorporates a first opening 51 and a second opening 52, which face in circumferentially opposite directions and are disposed substantially parallel to the direction of rotation of the rotating cylinder 10. The first and second openings 51, 52 define first and second channels, respectively, that direct condensate flow to the interior of the contoured syphon shoe 50 regardless of the direction that the rotating cylinder 10 is rotating. The first and second openings 51, 52 may be substantially arcuate. The first and second openings 51, 52 may each have a central portion 53 and opposing end portions 54. The opposing end portions 54 may be defined by convex arcuate segments and the central portion 53 may be defined by a concave arcuate segment. The diameter of each of the opposing end portions 54 may be larger than the height of the central portion 53, which can result in the opposing end portions 54 extending upward, away from a bottom 59 of the contoured syphon shoe 50.

The contoured syphon shoe 50 incorporates an internal divider 60 that separates the first opening 51 from the second opening 52. The divider 60 effectively prevents the condensate from by-passing the syphon pipe 28 and effectively seals off steam from leaving the rotating cylinder 10 without first condensing. The divider 60 extends radially away from an inside surface 35 of the rotating cylinder 10 toward the axis of rotation of the rotating cylinder 10 and has two surfaces 61, 62 that substantially face the first and second openings 51, 52, respectively. The surfaces 61, 62 of the divider 60 may have a curved contour to reduce the differential pressure required to entrain and lift the condensate into the syphon pipe 28. The curved contours of the surfaces 61, 62 begin with a shallow angle to the circumferential direction, gradually and smoothly transitioning to a surface 63 that extends toward the radial syphon pipe 28 at an angle that approaches perpendicular to the inside surface 35 of the interior wall 34 of the rotating cylinder 10. The initial shallow angle is less than 30°, preferably less than 15° or 20° in the circumferential direction.

The height of the divider 60 and the height of the first and second openings 51, 52 can vary. The height of the divider 60 may alternatively be less than the radius of a central bore 23 of the radial syphon pipe 28, less than the height of the first and second openings 51, 52, or less than the radius of curvature of the curved divider surface. The height of the first and second openings 51, 52 may alternatively be at least the height of the divider 60, at least twice the radius of curvature of the curved divider surface, or at least a radius of the central bore 23 of the radial syphon pipe 28.

As shown, the contoured syphon shoe 50 is affixed to the syphon pipe 28 utilizing a circumferential clamp and a clamping groove (not shown). The contoured syphon shoe 50 is provided with a complimentary collar 25 engageable with the clamping groove on the syphon pipe 28. The collar 25 is adjustable to tighten around the circumference of both the contoured syphon shoe 50 and the syphon pipe 28, wherein a portion of the clamp is frictionally secured to the syphon pipe 28 and the collar 25 of the contoured syphon shoe 50 is engaged in the clamping groove of the syphon pipe 28. It is anticipated that other methods of securement between the contoured syphon shoe 50 and the syphon pipe 28 may be used.

The contoured syphon shoe 50 is manufactured from materials that do not readily corrode or erode nor weaken at high operating temperatures. Although the clamp may be made of metal to securely hold the contoured syphon shoe 50 to the syphon pipe 28, at least the bottom 59 of the contoured syphon shoe 50 may be made from a material that is softer than the inside surface 35 of the rotating cylinder 10. Ideally, the material used for the bottom 59 of the syphon shoe 50 is a high-molecular-weight solid compound of carbon and fluorine, such as synthetic fluoropolymer of tetrafluoroethylene or polytetrafluoroethylene (PTFE or Teflon).

When utilized, the bottom 59 of the contoured syphon shoe 50 is positioned proximate the interior wall 34 of the rotating cylinder 10. In this fashion, as the interior wall 34 of the rotating cylinder 10 rotates in either a clockwise or counter-clockwise direction, condensate is urged to enter either the first opening 51 or the second opening 52 in the contoured syphon shoe 50, depending upon the direction of rotation of the interior wall 34 of the rotating cylinder 10. The divider 60 is contoured to provide a scoop action to lift rimming condensate from the inside surface 35 of the rotating cylinder 10 and redirect the condensate up and into a central bore 56 of the contoured syphon shoe 50 and into the radial syphon pipe 28.

Having described the contoured syphon shoe 50 in detail, it will be appreciated that the description is for purposes of illustration only and is not intended to be exhaustive, or to limit the invention to the precise disclosure, and that many modifications and variations are possible without deviating from the above teaching.

What is claimed is:

1. An apparatus for removing fluid from a cylinder, the apparatus comprising a syphon shoe connected to a syphon pipe, the syphon shoe comprising:

two opposing circumferential openings extending through an outer wall of the syphon shoe, the openings being disposed substantially parallel to a direction of rotation of the cylinder; and a divider separating the opposing circumferential openings, the divider extending from an end of the syphon shoe 50.

2. The apparatus of claim 1, wherein the divider has two surfaces, each facing one of the opposing circumferential openings, the two surfaces being contoured.

3. The apparatus of claim 2, wherein the contour is curved.

4. The apparatus of claim 3, wherein the contour defines an angle progressively increasing from less than 30° to approximately 90°.

5. The apparatus of claim 1, wherein the height of the divider is less than a radius of a central bore of the syphon pipe.

6. The apparatus of claim 3, wherein the divider defines a height less than a radius of curvature of the surfaces of the divider.

7. The apparatus of claim 1, wherein the divider defines a height less than a height defined by the opposing circumferential openings.

8. The apparatus of claim 1, wherein the opposing circumferential openings define heights at least as great as a height defined by the divider.

9. The apparatus of claim 3, wherein the opposing circumferential openings define heights at least twice a radius of curvature of the surfaces of the divider.

10. The apparatus of claim 1, wherein the opposing circumferential openings define heights at least as great as a radius of a central bore of the syphon pipe.

11. The apparatus of claim 1, wherein each of the opposing circumferential openings has a central portion and opposing end portions, the opposing end portions extending upward away from a bottom of the syphon shoe.

12. The apparatus of claim 1, wherein each of the opposing circumferential openings has a central portion defined by a concave arcuate segment and opposing end portions defined by convex arcuate segments.

13. The apparatus of claim 12, wherein the opposing end portions define diameters larger than a height of the central portion.

14. The apparatus of claim 1, wherein the syphon shoe is constructed of a material which is softer than the inside surface of the cylinder.

15. The apparatus of claim 14, wherein said material comprises a high molecular weight solid compound of carbon and fluorine.

16. An apparatus for removing fluid from a cylinder, the apparatus comprising:

a syphon shoe configured and dimensioned for connection to a syphon pipe, the syphon shoe including two opposing circumferential openings extending through an outer wall of the syphon shoe and disposed substantially parallel to a direction of rotation of the cylinder; and a divider separating the opposing circumferential openings, the divider extending from an end of the syphon shoe and having two curved surfaces that face the opposing circumferential openings, each of the opposing circumferential openings having a central portion and opposing end portions.

17. The apparatus of claim 16, wherein the curved surfaces define angles progressively increasing from less than 30° to approximately 90°.

18. The apparatus of claim 17, wherein the central portion of the openings is defined by a concave arcuate segment and the opposing end portions are defined by convex arcuate segments.

19. The apparatus of claim 18, wherein the divider defines a height less than a height defined by the opposing circumferential openings.

20. The apparatus of claim 19, wherein the syphon shoe is constructed of a material which is softer than an inside surface of the cylinder.

* * * * *